US006212795B1

(12) United States Patent
Nakabe et al.

(10) Patent No.: US 6,212,795 B1
(45) Date of Patent: Apr. 10, 2001

(54) SHOE SOLE WITH REINFORCED SUPPORT STRUCTURE

(75) Inventors: Noboru Nakabe; Masashi Isobe; Tsuyoshi Nishiwaki; Shigeyuki Mitsui, all of Kobe (JP)

(73) Assignee: Asics Corporation (JP)

( * ) Notice: Subject to any disclaimer, the term of this patent is extended or adjusted under 35 U.S.C. 154(b) by 0 days.

(21) Appl. No.: 09/429,858

(22) Filed: Oct. 29, 1999

(30) Foreign Application Priority Data

Nov. 5, 1998 (JP) ..... 10-330219

(51) Int. Cl.[7] ..... A43B 13/00; A43B 23/00; A43B 7/22

(52) U.S. Cl. ..... 36/25 R; 36/107; 36/91; 36/76 R

(58) Field of Search ..... 36/25 R, 88, 91, 36/107, 108, 114, 30 R, 31, 76 R

(56) References Cited

U.S. PATENT DOCUMENTS

| | | | |
|---|---|---|---|
| 4,546,559 | | 10/1985 | Dassler . |
| 4,686,994 | | 8/1987 | Harr et al. . |
| 4,731,940 | | 3/1988 | Zanatta et al. . |
| 5,052,130 | | 10/1991 | Barry et al. . |
| 5,282,326 | | 2/1994 | Schroer, Jr. et al. . |
| 5,319,866 | | 6/1994 | Foley et al. . |
| 5,325,611 | * | 7/1994 | Dyer et al. ..... 36/30 R |
| 5,400,528 | | 3/1995 | Skinner et al. . |
| 5,528,842 | | 6/1996 | Ricci et al. . |
| 5,832,634 | | 11/1998 | Wong . |
| 5,903,985 | | 5/1999 | DeMarchi . |
| 5,915,820 | | 6/1999 | Kraeuter et al. . |
| 6,041,522 | * | 3/2000 | Anteby ..... 36/30 R |

FOREIGN PATENT DOCUMENTS

| | | |
|---|---|---|
| 7-79804 | 3/1995 | (JP) . |
| 7-34703 | 6/1995 | (JP) . |

* cited by examiner

*Primary Examiner*—M. D. Patterson
(74) *Attorney, Agent, or Firm*—Michael E. Zall

(57) ABSTRACT

A one piece molded arched support member reinforcing device 3 for a shoe sole is provided. The member comprises a front support portion 30 and a rear support portion 31 molded integrally with an arch portion 3*a*. The front support portion 30 and the rear support portion 31 are disposed in front and at the back of the reinforcing device 3, respectively. These individual support portions 30 and 31 are clamped between an outer sole 1 and a midsole 2 of a shoe sole S. Preferably, the front support portion 30 of the reinforcing device 3 is supported by a tapered inclined face 10 which is inclined to ascend as it goes forward F.

9 Claims, 7 Drawing Sheets

SHOE SOLE WITH REINFORCED SUPPORT STRUCTURE

BACKGROUND OF THE INVENTION

1. Field of the Invention

The present invention relates to a shoe sole having reinforced structure.

2. Description of the Related Art

It is well known to have a reinforcing member in the arch portion of the sole of a shoe conforming to the shape of the treadless portion of the midsole, i.e., the portion of the midsole not attached to an outer sole that does not have ground contact when the outer sole is grounded. Such reinforcing device reinforces the rigidity of the treadless portion of the midsole by suppressing the deformation of the midsole. These known devices are exemplified those shown in FIGS. 6(*a*) and 6(*b*) and FIGS. 7(*a*) and 7(*b*), herein.

FIG. 6(*a*) exemplifies the side elevation of a prior art shoe sole disclosed in the Japanese Laid-Open Utility Model Publication (unexamined) No. 7-34703 (Published on Jun. 27, 1995). FIG. 6(*b*) is the bottom view of such prior art shoe sole. In this prior art shoe sole, the reinforcing member 3 of the treadless portion of the midsole is an integrally formed member that includes an arch portion 3*a,* a front support portion 30 at the front end of the sole and a rear support portion 31 at a rear end of the sole. The arch portion 3*a* is affixed on its back face to the midsole 2. The front support portion 30 and the rear support portion 31 are disposed, respectively, at the front and rear of the arch portion 3*a*. The front support portion 30 is sandwiched between the midsole 2 and an outer sole 1 below the midsole 2. The front support portion 30 is supported on a front supporting face 1F of the upper surface of the outer sole 1. The rear support portion 31 is sandwiched between the midsole 2 and the outer sole 1. The rear support portion 31 is supported on a rear supporting face 1B of the upper face of the outer sole 1.

FIG. 7(*a*) exemplifies the side elevation of another prior art shoe sole as disclosed in the Japanese Patent Publication (unexamined) No. 7-79804 (Published on Mar. 28, 1995). FIG. 7(*b*) is a bottom side perspective view of such prior art shoe sole. This sole is substantially similar to the afore-described prior art sole.

Additionally, the reinforcing device 3 is made of a sufficiently soft or flexible material to permit the shoe sole to have a torsional motion. Because of this, the front support portion 30 and the rear support portion 31 of the reinforcing device 3 can displace longitudinally upon the grounding of the sole. This can cause the reinforcing device 3 to longitudinally extend, flattening the arch portion 3*a* of the reinforcing device 3. This causes the treadless portion of the midsole 2 to depress toward the ground causing stress on the arch of the foot.

SUMMARY OF THE INVENTION

It is an object of this invention to provide a reinforcing support structure for the treadless portion of the midsole of the shoe to prevent the arch portion of the midsole from flattening.

The foregoing object as well as others is accomplished by the shoe sole of this invention that has an integrally reinforced portion. The shoe sole comprises an outer sole having a ground contact surface and an opposite upper surface and a midsole having portions thereof attached to and covered by the upper surface of the outer sole. A treadless portion of the midsole which is not attached to the upper surface of the outer sole and does not have ground contact when the ground contact surface of the outer sole is grounded has an arched support member. The support member comprises an arched portion, a front support portion disposed in front of the arched portion and a rear support portion disposed in the rear of the arched portion. The arched portion is affixed to the treadless portion of the midsole. The front support portion of the arched portion is affixed and sandwiched between the midsole and the outer sole below the midsole and supported on a front supporting face of the upper surface of the outer sole. The rear support portion is affixed and sandwiched between the midsole and the outer sole and supported on a rear supporting face of the upper surface of the outer sole.

The front supporting face of the upper surface of outer sole has a tapered inclined face ascending as it inclines in the forward direction and the front support portion of the arched support member is supported by such inclined face. Thus, the front support portion of the arched support member is inhibited from moving in a direction that opens the arched portion of the support member when the outer sole is grounded.

According to another aspect of the invention, additionally or alternatively, the rear supporting face of the upper surface of outer sole has a tapered inclined face ascending as it inclines in the backward direction. Thus the rear support portion of the arched support member is supported by the inclined face and is inhibited from moving in a direction that opens the arched portion of the support member when the outer sole is grounded.

According to yet another aspect of the invention, additionally or optionally, the rear supporting face of the upper surface of outer sole has a tapered inclined face descending as it inclines in the backward direction. Thus the rear support portion of the arched support member is supported by the inclined face and is inhibited from moving in a direction that opens the arched portion of the support member when the outer sole is grounded.

In accordance with this invention, when the sole of the shoe lands (or grounds), the front support portion and the rear support portion of the arched support member are clamped between the outer sole and the midsole. By these clamping actions, the front support portion and the rear support portion of the arched support member are difficult to displace (or move) forward and backward when a load is applied from above the arch at the time of landing. This inhibits or prevents the arch portion from being deformed to a flattened position thereby to suppress the depression of the treadless portion of the midsole.

In the preferred embodiment of this invention, the front support portion and the rear support portion of the arched support member are each supported by an inclined face to thus provide a wedged type structure. This wedging action suppresses the forward displacement of the front support portion and/or the backward displacement of the rear support portion. As a result, it is possible to suppress the depression or flattening of the treadless portion of the midsole.

BRIEF DESCRIPTION OF THE DRAWINGS

The invention will be more clearly understood from the following description of its preferred embodiments, as made with reference to the accompanying drawings. However, those embodiments and drawings are presented merely for illustrations and explanations. This scope of the invention is defined on the basis of the appended claims. In the accompanying drawings, the common reference numerals designate identical or corresponding portions.

FIG. 1(*b*) is a sectional view schematically showing another embodiment of a support structure used in this invention. FIG. 1(*c*) is a sectional view schematically showing a third embodiment of the support structure used in this invention.

FIG. 2(*a*) is a bottom view of a shoe sole before an outer sole is mounted, and FIG. 2(*b*) is a side elevation of such shoe sole with the outer sole mounted on the midsole.

FIG. 3(*b*) is a side elevation of such reinforcing device for use on a right shoe. FIG. 3(*c*) is a sectional view taken along line IIIc—IIIc of FIG. 3(*a*).

FIG. 5(*b*) is a sectional view of the embodiment depicted in FIG. 5(*a*). FIG. 5(*c*) is a sectional view of the embodiment depicted in FIG. 5(*a*) with modifications thereto.

FIG. 6(*b*) is a schematic bottom view of the prior art shoe sole depicted in FIG. 6(*a*).

FIG. 7(*b*) is a bottom perspective view of of the prior art shoe sole depicted in FIG. 7(*a*).

DESCRIPTION OF THE PREFERRED EMBODIMENTS

Figure 6A:
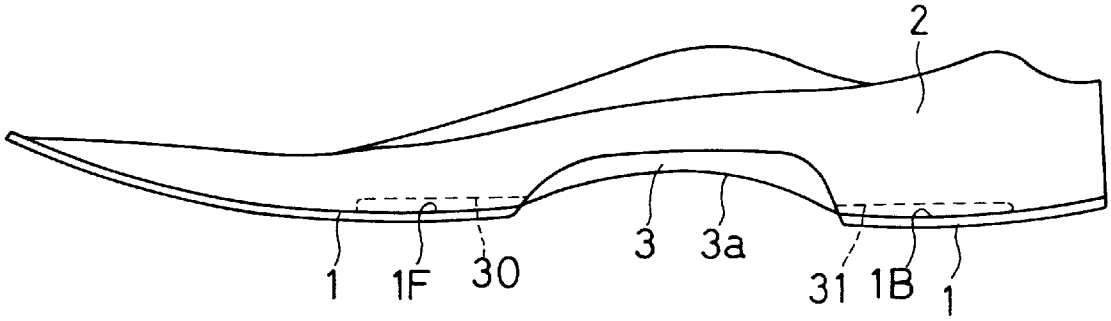
FIG.6(a) PRIOR ART
FIG. 6(*a*) is a schematic side elevation of a prior art shoe sole.
Figure 6B:
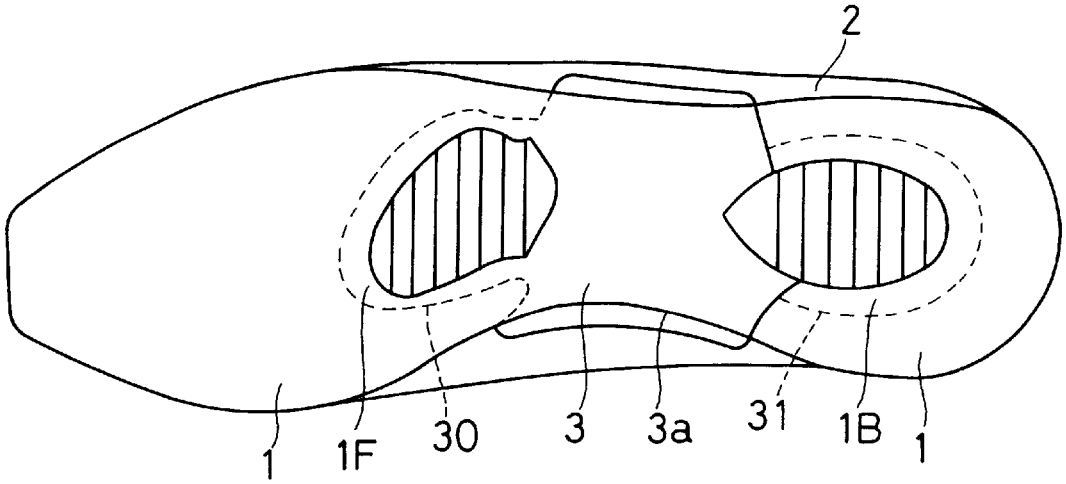
FIG.6(b) PRIOR ART
Figure 7A:
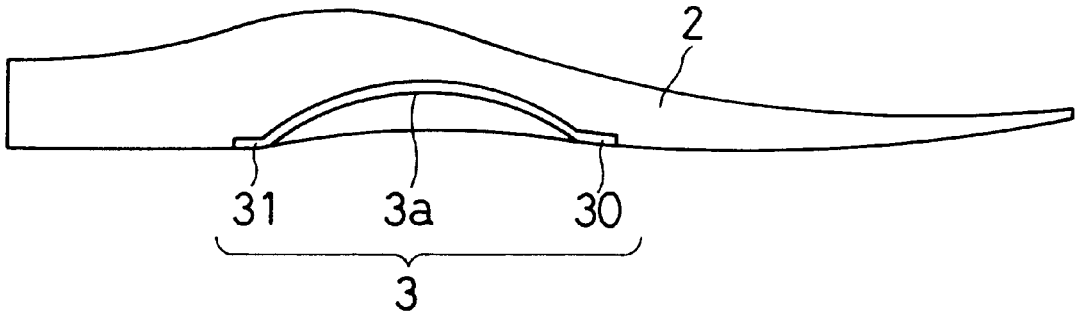
FIG.7(a) PRIOR ART
FIG. 7(*a*) is a side elevation of another prior art shoe sole.
Figure 7B:
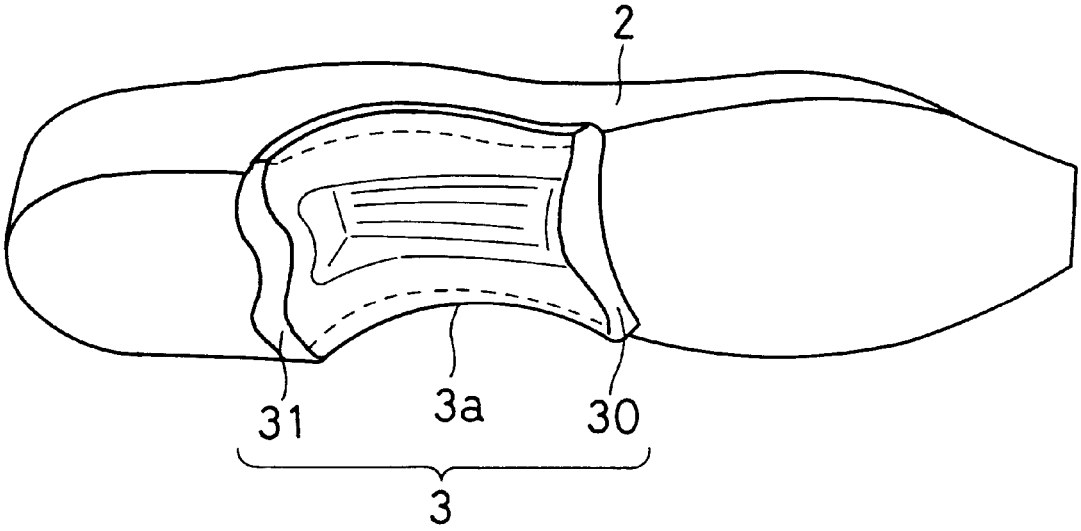
FIG.7(b) PRIOR ART

This invention will be described in connection with its embodiments with reference to the accompanying drawings. The description herein is primarily directed to the portions of the invention which are different from the prior art depicted, i.e., FIGS. 6(*a*) and 6(*b*). A detailed description of the elements that are similar to that of the prior art depicted will be omitted and/or will be designated by the same reference numerals.

Principle Embodiment

The basic structure and principle of this invention will be described with reference to the embodiment depicted in FIG. 1(*a*).

Figure 1A:
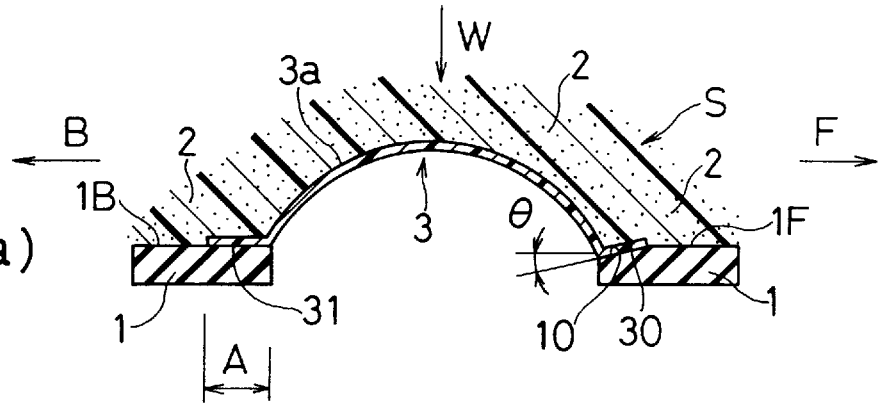
FIG. 1(*a*) is a sectional view schematically showing one embodiment of a support structure, i.e., an arched support member, used in this invention.
Figure 1B:
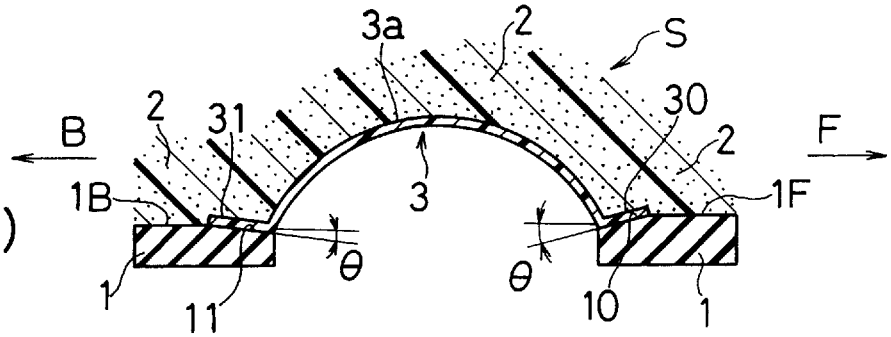
Figure 1C:
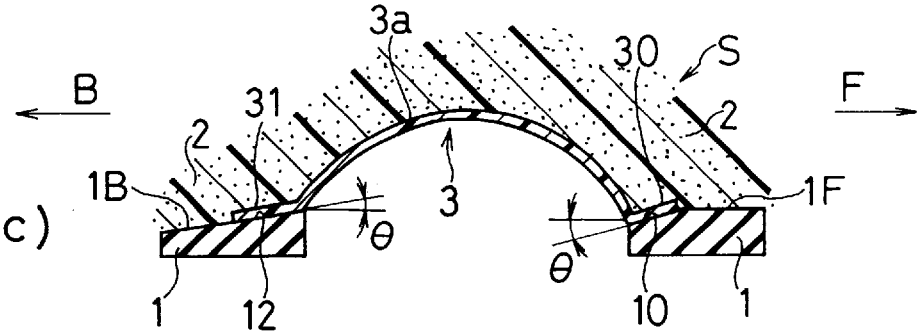

In FIG. 1(*a*), wherein the F arrow is the direction toward the front of the shoe and the B arrow is the direction toward the rear or back of the shoe, the arched support member/a reinforcing device 3 of a shoe sole is provided with a front support portion 30 at the front end and a rear support portion 31 at the rear end. These support portions are integrally molded with an arch portion 3*a* to form a molded, one piece, arched support member 3. The front support portion 30 and the rear support portion 31 are disposed respectively at the front and rear end portions of the arched support member 3. These individual support portions 30 and 31 are clamped between an outer sole 1 and a midsole 2 of a shoe sole S. As depicted in FIG. 1(*a*), the arched support member 3 receives a load W from above when the sole is grounded. This clamping action of the support portions 30, 31 between the outer sole 1 and midsole 2 inhibits or prevents the front support portion 30 and the rear support portion 31 of the reinforcing device 3 from moving in a direction to open the arch portion 3*a* of the reinforcing device 3 when the shoe sole S is grounded.

More specifically, still referring to FIG. 1(*a*), upon grounding, the arch portion 3*a* wants to deform and flatten due to the vertical load W applied to the shoe sole S. Counteracting this tendency is the fact that the front support portion 30 and the rear support portion 31 of the reinforcing device 3 are clamped/affixed between the outer sole 1 and the midsole 2. This structure prevents the front support portion 30 and the rear support portion 31 from being displaced forward F and backward B. This thus reduces the vertical displacement of the arch portion 3*a*.

Referring to the embodiment depicted in FIG. 1(*a*), the front support portion 30 of the reinforcing device 3 is supported on a tapered first inclined face 10 which is inclined to ascend as it goes forward F. This forms, in effect, a wedge. Thus in this embodiment, the front support portion 30 is supported on the first inclined face 10, i.e., the support portion 30 is supported by the formed wedge. As a result of this wedging effect, the front support portion 30 is prevented from moving forward F so that the arch portion 3*a* remains or tends to remain open.

Referring to FIG. 1(*b*), in this embodiment for a similar reason, the rear support portion 31 of the reinforcing device 3 is supported on a tapered inclined face 11 which is inclined to ascend as it goes backward B. This also contributes to maintaining the arch portion 3*a* in a stable or open position.

Referring to another embodiment depicted in FIG. 1(*c*), the rear support portion 31 is supported on a tapered inclined face 12 which is inclined to descend as it goes backward B. Such an inclination of the face 12 also produces a wedging effect or action. This is due to the fact that upon grounding, the outer sole 1 is grounded sequentially first from the back or rear B of the sole and then forward to the front F of the sole. However, the load W that is applied to the arch portion 3*a* is generally at its maximum when the outer sole 1 is grounded in front and at the back of the arch. It is, therefore, more effective and preferred to provide the inclined face 11 depicted in FIG. 1(*b*) rather than the inclined face 12 depicted in FIG. 1(*c*).

In all of the embodiments depicted in FIGS. 1(*a–c*), the preferred angle of inclination θ for each inclined face 10, 11 and 12 with respect to a horizontal plane is preferably at least about 3 Degrees or more, and most preferably at least about 5 Degrees or more. On the other hand, an area A of each inclined face 10, 11 and 12 is generally set to have a value of preferably at least about 0.8 $cm^2$ or more and most preferably at least about 2 $cm^2$ or more so as to clamp the individual support portions 30 and 31 sufficiently between the outer sole 1 and the midsole 2.

Specific Embodiments

Figure 2A:
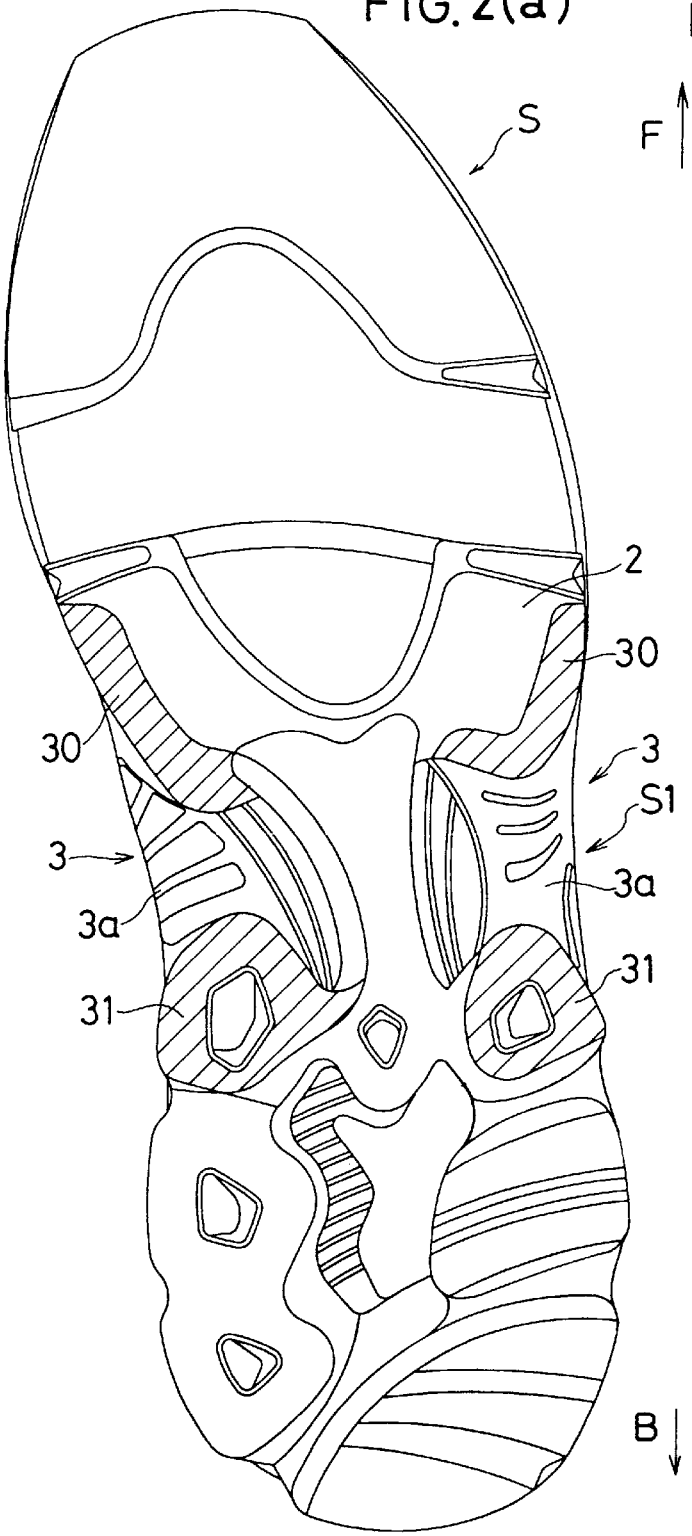
FIGS. 2(*a*) and 2(*b*) show yet another embodiment of the invention.
Figure 2B:
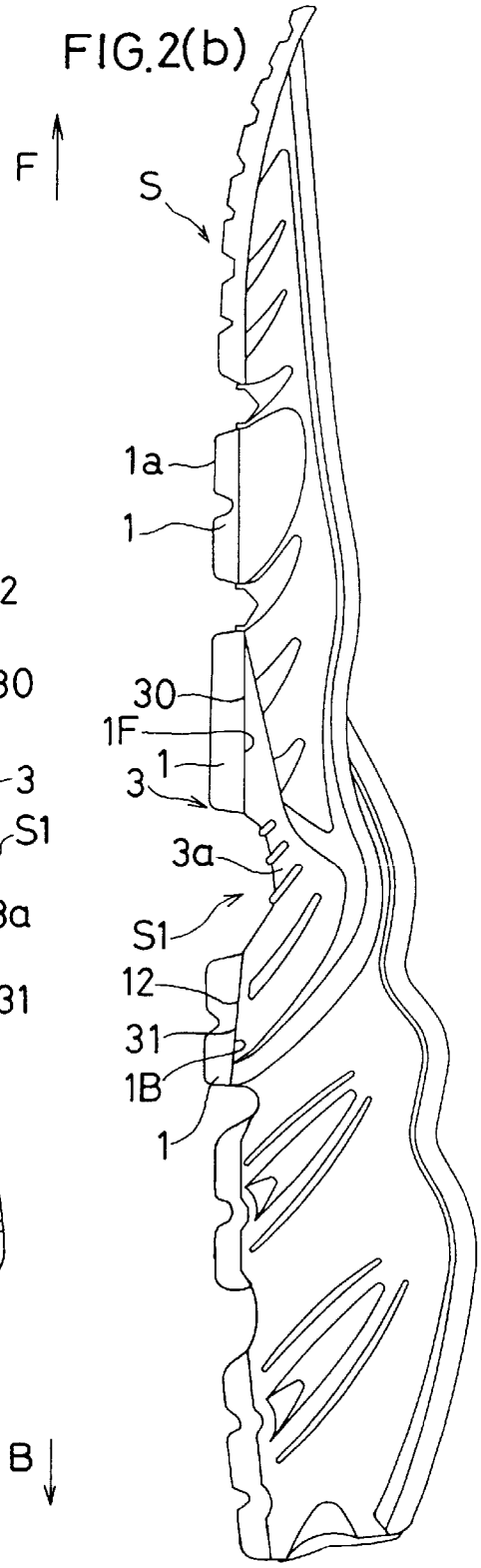
Figure 3A:
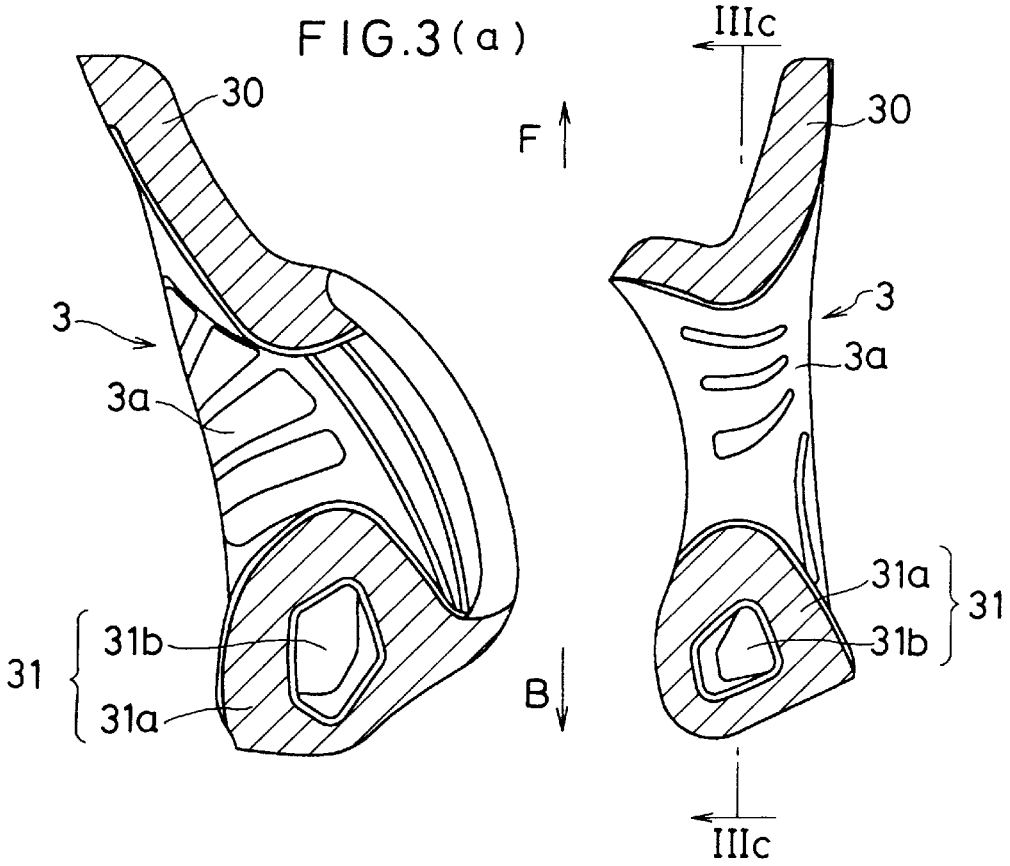
FIG. 3(*a*) is a bottom view of a pair of arched support reinforcing members or devices used in FIGS. 2(*a*).
Figure 3B:
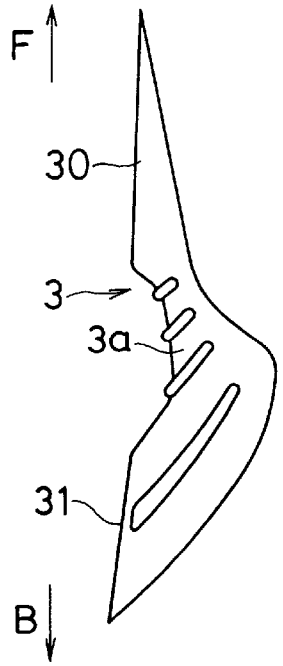
Figure 3C:
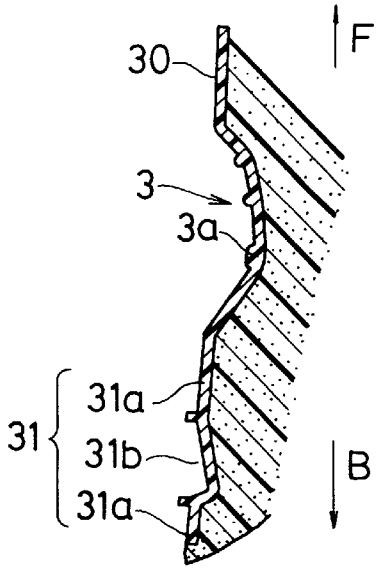

Another embodiment of this invention is depicted in FIGS. 2(*a*),(*b*) and FIGS. 3(*a*),(*b*),(*c*).

FIG. 2(*a*) is a bottom view of the shoe sole S before the outer sole 1 is fixed thereto. At the treadless portion S1 of the midsole 2 of the shoe sole S, a pair of reinforcing arched support members 3, shown in detail in FIG. 3(*a*), are fixed on the back face of the midsole 2. As shown in FIGS. 3(*a*) and 2(*a*), the front support portion 30 and the rear support portion 31 are hatched. Referring to FIGS. 2(*a*) and 2(*b*), below (toward the ground) the front support portion 30 and the rear support portion 31 (as hatched), there is fixed the outer sole 1—see FIG. 2(*b*). This outer sole 1 has a treading face 1*a* on its outer surface and is generally made of a foam or non-foam of rubber or resin. The midsole 2 is sandwiched between the upper (not-shown), as suited for enveloping the instep of a foot, and the outer sole 1 so that it absorbs the shocks upon landing and exhibits a repulsive force upon stepping. Generally, the midsole 2 is made of a foam of EVA or polyurethane and can include, for example, a cushioning system that includes air or a silicon gel. The arched support member or reinforcing device 3 is preferably made of a resilient, non-foam polymer.

Referring to FIG. 2(*b*), the outer sole 1 is provided with a front supporting face 1F for supporting the front support portion 30, and a rear supporting face 1B for supporting the rear support portion 31. The front supporting face 1F is set generally horizontally. The rear supporting face 1B is provided with the tapered inclined face 12 which is inclined to descend as it goes backward B. The rear support portion 31 is supported by the inclined face 12.

Still referring to FIG. 2(*b*), the inclined face 12 is formed to make the outer sole 1 generally gradually thinner as it goes toward the back B. As used herein, the phrase "generally gradually thinner" means the change in the thickness of the sole excluding the small antislipping rough surrface on the bottom face of the outer sole 1.

Referring to FIGS. 3(*a*) and 3(*c*), the rear support portion 31 has an annularly shaped portion 31*a*. A cup-shaped portion 31*b* is formed integrally with the rear support portion 31 at the center of the annular portion 31*a*. FIG. 3(*b*) is a side elevation of the arched support member 3 of a right shoe and FIG. 3(*c*) is a sectional view taken along line IIIc—IIIc of FIG. 3(*a*).

The cup-shaped portion 31*b* is formed integrally with the rear support portion 31 so that the rigidity of the rear support portion 31 is enhanced so that the arch portion 3*a* of the arched support member 3 is more difficult to flatten.

The cup-shaped portion 31*b* need not be smoothly curved, as long as it is generally "cup shaped". In the embodiment depicted in FIGS. 2(*a*), (*b*) and FIGS. 3(*a–c*), the cup-shaped portion 31*b* is recessed toward the midsole 2, however, optionally, it may protrude toward the grounding side.

Figure 4:
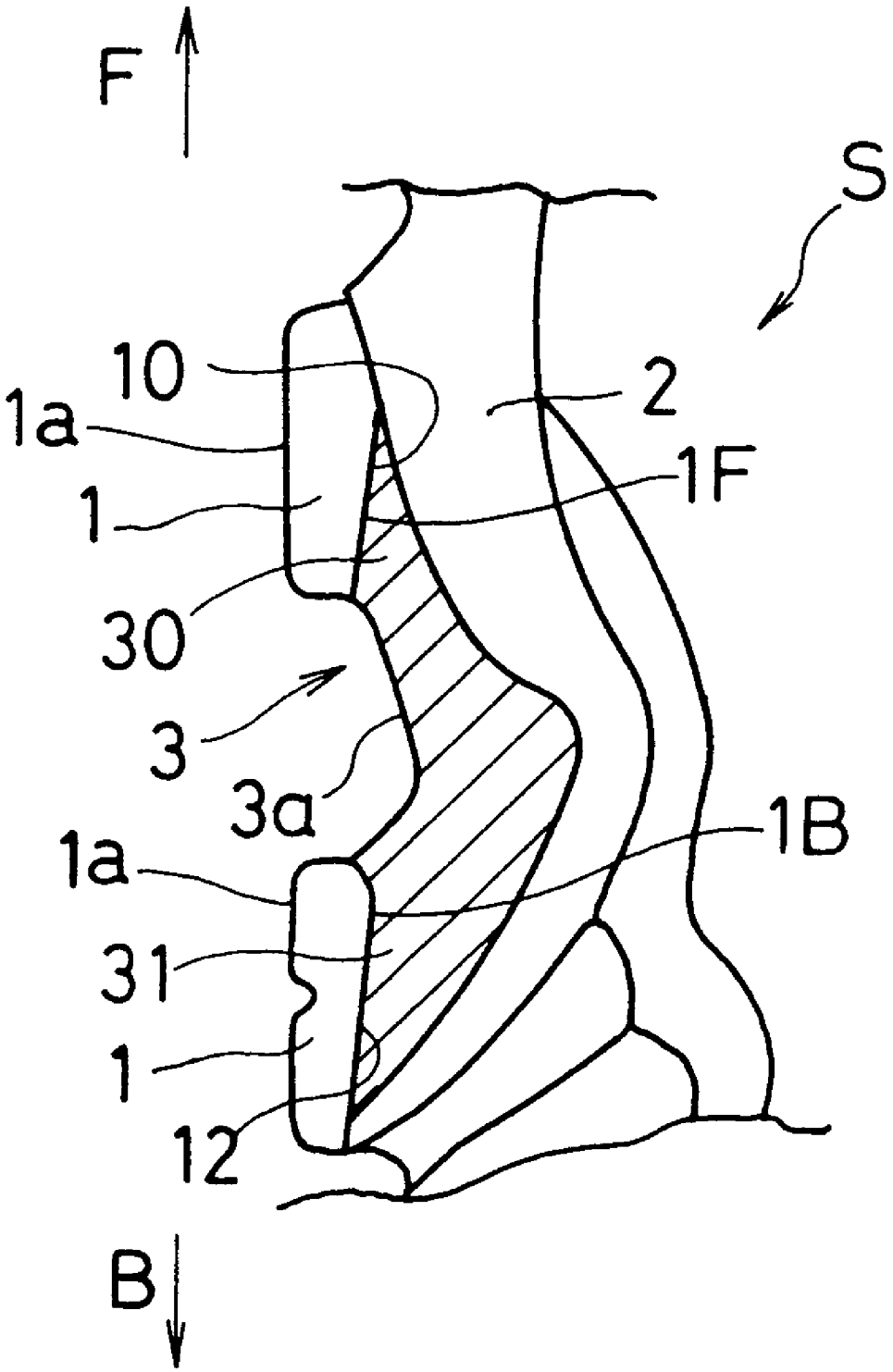
FIG. 4 is a side elevation of a shoe sole that includes yet another embodiment of this invention.

Referring to FIG. 4 in conjunction with FIG. 1(*c*), this drawing depicts another embodiment similar to that shown in FIG. 1(*c*), wherein the support portions 30 and 31 are supported by the inclined faces 10 and 12, respectively. In the embodiment depicted in FIG. 4, the arched support member or reinforcing device 3 is hatched to clearly indicate this essential element.

Still referring to FIG. 4, the front supporting face 1F of the outer sole 1 is provided with the tapered first inclined face 10 which is inclined to ascend as it goes forward F. The front support portion 30 of the reinforcing device 3 is supported by this first inclined face 10. This inclined face 10 is generally shaped so that the outer sole 1 gradually becomes thicker as it goes forward F.

The rear supporting face 1B of the outer sole 1 is provided with a tapered inclined face 12 which is inclined to descend as it goes backward B. The rear support portion 31 of the reinforcing device 3 is supported on this inclined face 12. This inclined face 12 is generally shaped so that the outer sole 1 gradually thinner as it goes backward B.

Figure 5A:
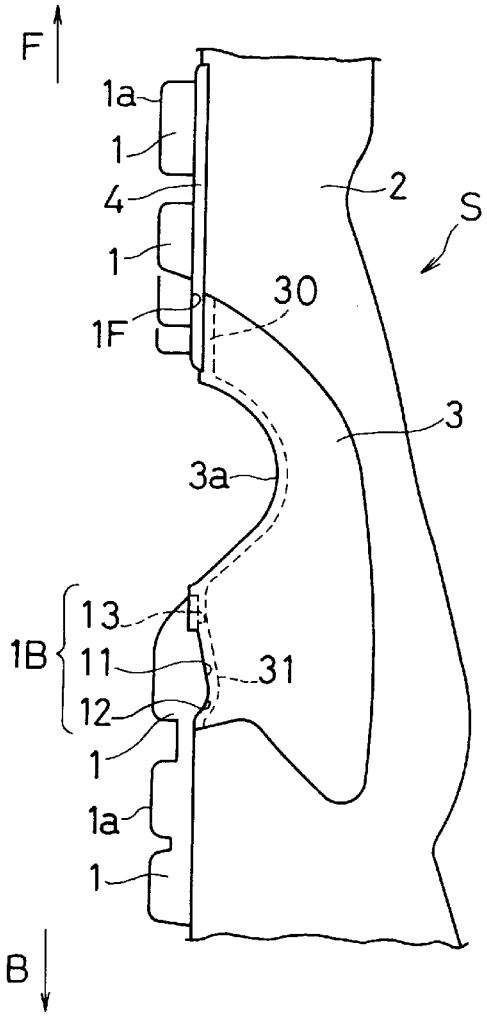
FIG. 5(*a*) is a side elevation showing another embodiment of this invention.
Figure 5B:
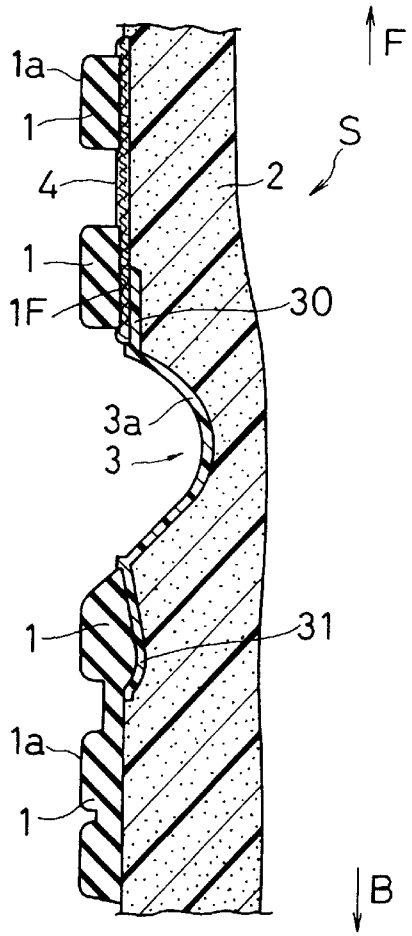
Figure 5C:
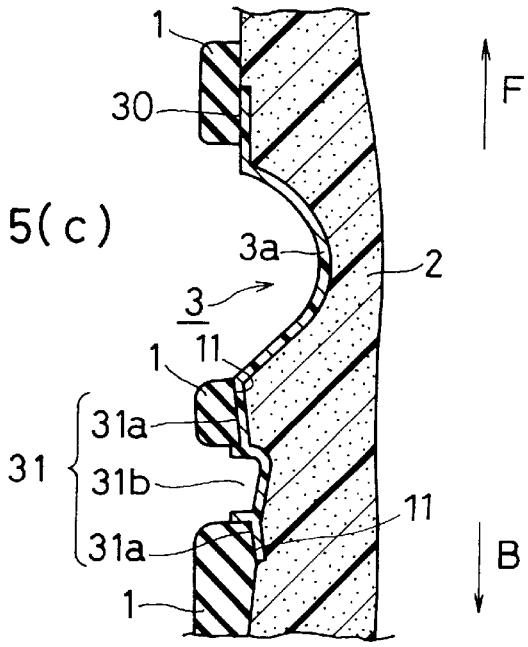

FIGS. 5(*a*),5(*b*), 5(*c*) depict another embodiment of this invention.

In this embodiment, the outer sole 1 of the front foot part is fixed on the bottom face of a nonwoven fabric 4. The front support portion 30 is sandwiched between the outer sole 1 and the midsole 2 with the nonwoven fabric 4. The front supporting face 1F of the outer sole 1 supporting the front support portion 30 is set generally horizontally. The rear support portion 31 is supported on the rear supporting face 1B of the outer sole 1.

The rear supporting face 1B is continuously formed and includes a horizontal face 13, an inclined face 11 and another inclined face 12. The horizontal face 13 also supports the rear support portion 31 of the reinforcing device 3.

In this embodiment, to form the inclined face 11, the outer sole 1 becomes gradually thicker as the inclined face 11 goes backward B. In the portion of the other inclined face 12, on the other hand, the outer sole 1 is made generally gradually thinner as the inclined face 12 goes backward B.

Optionally, as shown in FIG. 5(*c*), the inclined face 11 may be made annular to form the cup-shaped portion 31*b* therein.

Although the preferred embodiments have been described with reference to the accompanying drawings, there are numerous changes and modification that could be made by one skilled in the art.

For example, the right and left arched support member or reinforcing devices may be formed integrally from one piece. On the other hand, the side face of the reinforcing device may be extended forward to the front of the front support portion or backward to the back of the rear support portion.

It is understood that the embodiments described herein are merely exemplary and that a person skilled in the art may make many variations and modifications without departing from the spirit and scope of the invention. All such variations and modifications are intended to be included within the scope of the invention.

What is claimed is:

1. A shoe sole with an integrally reinforced portion, the shoe sole comprising:

an outersole having a ground contact surface and an opposite upper surface;

a midsole having portions thereof attached to and covered by the upper surface of the outersole;

a treadless portion of the midsole not attached to the upper surface of the outersole that does not have ground contact when the ground contact surface of the outersole is grounded;

an arched support member comprising an arched portion, a front support portion disposed in front of the arched portion and a rear support portion disposed in the rear of the arched portion;

the arched portion being affixed to the treadless portion of the midsole;

the front support portion being affixed and sandwiched between the midsole and the outer sole below the midsole and supported on a front supporting face of the upper surface of the outer sole, and the rear support portion being affixed and sandwiched between the midsole and the outer sole and supported on a rear supporting face of the upper surface of the outer sole, wherein the front supporting face of the upper surface of the outer sole has a tapered inclined face ascending as it inclines in the forward direction;

wherein the thickness of the outer sole increases at the inclined face as the incline ascends in the forward direction; and wherein the front support portion of the arched support member is supported by the inclined face, whereby the front support portion of the arched support member is inhibited from moving in a direction that opens the arched portion of the support member when the outersole is grounded.

2. A shoe sole with an integrally reinforced portion, the shoe sole comprising:

an outersole having a ground contact surface and an opposite upper surface;

a midsole having portions thereof attached to and covered by the upper surface of the outersole;

a treadless portion of the midsole not attached to the upper surface of the outersole that does not have ground contact when the ground contact surface of the outersole is grounded;

an arched support member comprising an arched portion, a front support portion disposed in front of the arched portion and a rear support portion disposed in the rear of the arched portion;

the arched portion being affixed to the treadless portion of the midsole;

the front support portion being affixed and sandwiched between the midsole and the outer sole below the midsole and supported on a front supporting face of the upper surface of the outer sole, and the rear support portion being affixed and sandwiched between the midsole and the outer sole and supported on a rear supporting face of the upper surface of the outer sole, wherein the rear supporting face of the upper surface of the outer sole has a tapered inclined face ascending as it inclines in the backward direction;

wherein the thickness of the outer sole increases at the inclined face as the incline ascends in the backward direction; and wherein the rear support portion of the arched support member is supported by the inclined face, whereby the rear support portion of the arched support member is inhibited from moving in a direction that opens the arched portion of the support member when the outersole is grounded.

3. The shoe sole of claim 2, wherein the rear supporting face further comprises a horizontal face, and the rear support portion of the arched support member is supported by both the inclined face and horizontal face.

4. The shoe sole of claim 2, wherein the rear support portion of the arched support member has an annular portion formed in an annular shape, and a cup-shaped portion formed at the center of the annular portion into a cup shape, whereby the annular portion is supported on the inclined face.

5. A shoe sole with an integrally reinforced portion, the shoe sole comprising:

an outer sole having a ground contact surface and an opposite upper surface;

a midsole having portions thereof attached to and covered by the upper surface of the outer sole;

a treadless portion of the midsole not attached to the upper surface of the outer sole that does not have ground contact when the ground contact surface of the outer sole is grounded;

an arched support member comprising an arched portion, a front support portion disposed in front of the arched portion and a rear support portion disposed in the rear of the arched portion;

the arched portion being affixed to the treadless portion of the midsole;

the front support portion being affixed and sandwiched between the midsole and the outer sole below the midsole and supported on a front supporting face of the upper surface of the outer sole, and the rear support portion being affixed and sandwiched between the midsole and the outer sole and supported on a rear supporting face of the upper surface of the outer sole, wherein the rear supporting face of the upper surface of outer sole has a tapered inclined face descending as it inclines in the backward direction; and wherein the rear support portion of the arched support member is supported by the inclined face, whereby the rear support portion of the arched support member is inhibited from moving in a direction that opens the arched portion of the support member when the outer sole is grounded.

6. The shoe sole of claim 5, wherein the thickness of the outer sole decreases at the inclined face as the incline descends in the backward direction.

7. The shoe sole of claim 5, wherein the rear supporting face further comprises a horizontal face, and the rear support portion of the arched support member is supported by both the inclined face and horizontal face.

8. The shoe sole of claim 5, wherein the rear support portion of the arched support member has an annular portion formed in an annular shape, and a cup-shaped portion formed at the center of the annular portion into a cup shape, whereby the annular portion is supported on the inclined face.

9. A shoe sole with an integrally reinforced portion, the shoe sole comprising:

an outersole having a ground contact surface and an opposite upper surface;

a midsole having portions thereof attached to and covered by the upper surface of the outersole;

a treadless portion of the midsole not attached to the upper surface of the outersole that does not have ground contact when the ground contact surface of the outersole is grounded;

an arched support member comprising an arched portion, a front support portion disposed in front of the arched portion and a rear support portion disposed in the rear of the arched portion;

the arched portion being affixed to the treadless portion of the midsole;

the front support portion being affixed and sandwiched between the midsole and the outer sole below the midsole and supported on a front supporting face of the upper surface of the outer sole, and the rear support portion being affixed and sandwiched between the midsole and the outer sole and supported on a rear supporting face of the upper surface of the outer sole, wherein the rear supporting face of the upper surface of outer sole has a tapered inclined face ascending as it inclines in the backward direction; and wherein the rear support portion of the arched support member is supported by the inclined face, wherein the rear support portion of the arched support member has an annular portion formed in an annular shape, and a cup-shaped portion formed at the center of the annular portion into a cup shape, whereby the annular portion is supported on the inclined face;

whereby the rear support portion of the arched support member is inhibited from moving in a direction that opens the arched portion of the support member when the outersole is grounded.

* * * * *